United States Patent [19]

Davis

[11] Patent Number: 4,689,549

[45] Date of Patent: Aug. 25, 1987

[54] MONOLITHIC CURRENT SPLITTER FOR PROVIDING TEMPERATURE INDEPENDENT CURRENT RATIOS

[75] Inventor: William F. Davis, Tempe, Ariz.

[73] Assignee: Motorola, Inc., Schaumburg, Ill.

[21] Appl. No.: 880,610

[22] Filed: Jun. 30, 1986

[51] Int. Cl.[4] ..... G05F 3/16

[52] U.S. Cl. ..... 323/315; 323/354; 323/907

[58] Field of Search ..... 323/315, 316, 354, 907; 307/310; 330/256, 288

[56] References Cited

U.S. PATENT DOCUMENTS 4,147,971 4/1979 Price ..... 323/315

4,435,678 3/1984 Joseph et al. ..... 323/315

*Primary Examiner*—Patrick R. Salce
*Assistant Examiner*—Judson H. Jones
*Attorney, Agent, or Firm*—Mike Bingham

[57] ABSTRACT

A circuit for providing multiple currents the ratios of which are constant and temperature independent. The circuit includes at least first and second transistors the bases of which are shorted together and whose emitters are interconnected via respective trimmable resistors to a thermal current supply. By driving the transistors with a thermal current and trimming one or the other or both resistors the current ratios can be adjusted and will remain constant as temperature is varied.

4 Claims, 4 Drawing Figures

MONOLITHIC CURRENT SPLITTER FOR PROVIDING TEMPERATURE INDEPENDENT CURRENT RATIOS

CROSS REFERENCE TO A RELATED APPLICATION

The subject matter of this invention is related to the subject matter of a patent application, Ser. No. 879,879, Entitled "Current Mirror Circuit And Method For Providing Zero Temperature Coefficient Trimmable Current Ratios" filed concurrently herewith and assigned to the assignee of the subject invention.

BACKGROUND OF THE INVENTION

This invention relates to current ratioing and, more particularly, to current splitter circuits for providing multiple output currents having precise ratios with respect to each other. Further, the present invention pertains to a resistive trim technique such that the ratios of the output currents may be adjusted wherein the adjusted ratios are temperature independent.

Current splitting techniques are known. One method realized to provide output currents having a predetermined ratio with respect to each other is the common current mirror circuit. The current mirror comprises a diode-connected transistor coupled in a parallel current path to the base-emitter conduction path of a transistor of like conductivity type. An input current supplied to the diode is mirrored through the collector-emitter conduction path of the transistor as understood. By area ratioing the emitters of the two transistors the ratio of the current flow through the transistor can be set with respect to the input current flow through the diode-connected transistor. The current ratio can also be set by utilizing trimmable resistors in the respective emitter conduction paths of the two transistors. By trimming one or the other or even both resistors the current ratios can be adjusted.

A problem with some prior art current splitters is that even though the current ratios can be precisely set at ambient temperature by trimming of resistors the ratios are not temperature independent. Thus, as temperature varies the current ratios will not remain constant but will also vary. In many applications this is very undesirable.

Hence, a need exists for a current splitter for providing currents having adjustable current ratios that are temperature independent.

SUMMARY OF THE INVENTION

Accordingly, it is an object of the present invention to provide an improved current splitter circuit.

Another object of the invention is to provide an improved integrated resistively trimmable current splitter circuit in which the ratio of output currents can be adjusted with the adjusted current ratios remaining temperature independent.

In accordance with the above and other objects there is provided a circuit for supplying multiple currents the ratios of which are constant and temperature independent comprising at least first and second transistors the control electrodes of which are connected together, trimmable resistive elements coupling respectively a first electrode of each transistor to a common node and a thermal current supply for providing a thermal current flow through the transistors at the common node.

DETAILED DESCRIPTION OF THE PREFERRED EMBODIMENTS

Figure 1:
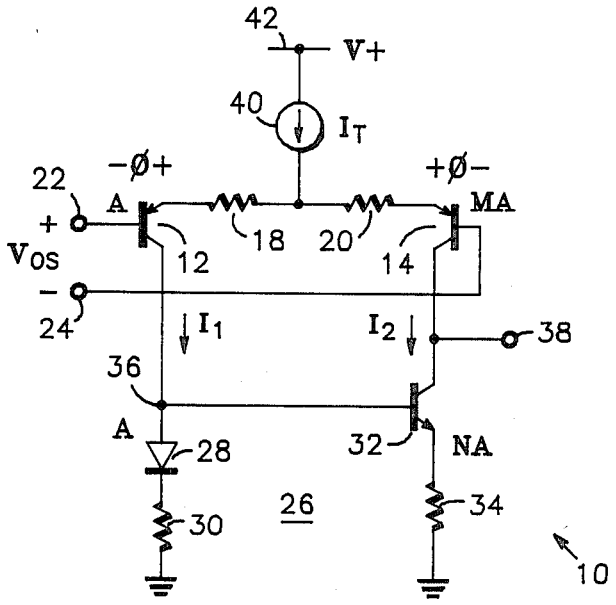
FIG. 1 is a schematic diagram of a resistive trimmable differential amplifier useful for understanding the present invention.

Turning now to FIG. 1 there is shown differential amplifier 10 in which the offset voltage $V_{OS}$ can be adjusted to substantially zero volts and in which the adjusted or trimmed value remains temperature independent. It is understood that differential amplifier 10 is suited to be manufactured in monolithic circuit form. The basic difference between prior art differential amplifiers and differential amplifier 10 will be made clear from the following description. Because the basic operation of differential amplifier 10 is known (see for instance U.S. Pat. No. 3,872,323) only a brief explanation will be given.

Differential amplifier 10 comprises a pair of PNP transistors 12 and 14 the emitters of which are differentially coupled to circuit node 16 via resistors 18 and 20. The bases of transistors 12 and 14 are respectively coupled to the differential inputs 22 and 24 of differential amplifier 10 to which a differential input signal may be applied. The collectors of the two transistors are coupled to current mirror circuit 26 the latter of which provides differential-to-single ended signal conversion as understood. Current mirror circuit 26 includes semiconductor diode means 28, coupled between the collector of transistor 12 and ground reference potential via resistor 30, and NPN transistor 32. Transistor 32 has its collector-emitter conduction path coupled between the collector of transistor 14 and ground reference via resistor 34 and its base connected to the collector of transistor 12 at node 36. The output of differential amplifier 10 may be taken at output 38. Current source 40 provides a DC tail current $I_T$ to node 16 from power supply conductor 42.

Diode means 28, as is known, may be formed of a NPN transistor has its collector shorted to its base at node 36 and to the base of transistor 32. The emitter areas of transistor 32 and the transistor forming diode means 28 may be ratioed with respect to one another. For example, the area of the emitter of transistor 32 is shown as being N times the corresponding emitter area of diode means 28, where N is any positive number. Similarly, the emitter area of transistor 14 may be M times the emitter area of transistor 12, where M is any positive number. It is also understood that N and M could model the mismatch between the respective devices.

In operation, a differential input signal will produce related currents at the collectors of transistors 12 and 14. Current mirror circuit 26 provides a single output current at output 38 in response to the differentially related currents.

Ideally, with the bases of transistors 12 and 14 at equal potentials, tail current $I_T$ will be evenly split between the two transistors to produce equal currents I1 and I2. However, in reality, due to process tolerances, the elements of differential amplifier 10 are not perfectly matched. Therefore, currents I1 and I2 will not be equal and an offset voltage $V_{os}$ is produced across inputs 22 and 24 which is undesirable. This offset voltage which may, for example, have the polarity as shown can be trimmed to substantially zero volts by adjusting the resistive elements of the differential amplifier.

By making tail current $I_T$ a thermal current, i.e., a current whose magnitude is proportional to absolute temperature T and inversely proportional to the resistance of a given resistivity, any of the resistive elements or emitter areas of differential amplifier 10 may be trimmed or adjusted to adjust $V_{os}$ to zero volts and that the resulting trimmed $V_{os}$ will have a zero TC which is highly desirable. Therefore, differential amplifier 10 as described has a trimmable offset voltage that once trimmed to a predetermined value will not substantially change with temperature: provided that $I_T$ is a thermal current of the form:

$$I_T=(kT/qR)\ln K_0 \quad (1)$$

where:

k is Boltzmann's constant q is the charge of an electron

R is a resistance of given resistivity and TC; and $K_0$ is a constant.

Current sources for providing the above described thermal current are well known.

The following illustrates mathematically the above stated results. It has been shown that if a resistive current mirror circuit is driven by a thermal current that the ratio of the current mirror currents I1/I2 is constant and temperature independent. The referenced patent application "Current Mirror Circuit And Method For Providing Zero Temperature Coefficient Trimmable Current Ratios" discloses such a current mirror and is incorporated herein by reference made thereto. Therefore, it has been shown that:

$$I1/I2=K_1 \quad (2)$$

where $K_1$ is a constant independent of temperature. This ratio can be shown to be equal to:

$$I1/I2=(1/M)e^{q(\phi 1-\phi 2)/kT} \quad (3)$$

where:

$\phi 1$ is the base-emitter voltage of transistor 12; and $\phi 2$ is the base-emitter voltage of transistor 14.

Thus, $$\phi 1 - \phi 2 = (kT/q)\ln M(I1/I2) \quad (4)$$

$$= (kT/q)\ln MK_1 \quad (5)$$

solving now for $V_{os}$, $$V_{os} = \phi 1 + I1R1 - I2R2 - \phi 2 \quad (6)$$

$$= \phi 1 - \phi 2 + (K_1R1 - R2)\, I2 \quad (7)$$

where:

R1 is the resistance of resistor 18; and

R2 is the resistance of resistor 20, where the resistivity of resistors 18 and 20 is the same as resistance R.

Substituting equation 5 into equation 7 and rearranging:

$$V_{os}=(kT/q)\ln MK_1+(K_1R1-R2)I2 \quad (8)$$

Since $$I1+I2=I_T \quad (9)$$

and from equation 2:

$$K_1(I2)+I2=I_T \quad (10)$$

thus:

$$I2=I_T/(K_1+1) \quad (11)$$

Substituting equation 11 into equation 8 yields:

$$V_{os} = (kT/q)\ln MK_1 + (K_1R1 - R2)(I_T/(K_1 + 1)) \quad (12)$$

$$= (kT/q)\ln MK_1 + (K_1R1 - R2)(kT/q)\ln K_0/(K_1 + 1)R \quad (13)$$

Thus, $V_{os}$ equals:

$$kT/q[\ln MK_1-(R2-K_1R1)(\ln K_0)/(K_1+1)R] \quad (14)$$

or $$kT/q[\ln MK_1-(R1/R)((R2/R1)-K_1)\ln K_0/(K_1+1)] \quad (15)$$

Since all of the terms of equation 15 enclosed within the brackets are constants, $$V_{os}=(kT/q)\, C \quad (16)$$

where C is a constant. If C is set to zero, which can be achieved for given values of $K_1$, M, R1, R2, R and $K_0$, $V_{os}$ can be set to zero independent of temperature. The ratio of I1 to I2, ($K_1$), can typically be adjusted by trimming resistors 30 and 34. Further, $K_1$ can be varied by different values of N. Thus, the term (1n $MK_1$) of equation 15 can be set equal to the term $(R1/R)((R2/R1)-K_1)\ln K_0/(K_1+1)$ thereby making C equal to zero. It is also understood that independently or in conjunction with adjusting $K_1$ resistors 18 and 20 (resistors R1 and R2 respectively) may be trimmed to also set C equal to zero.

Hence, by using a thermal tail current supply in conjunction with the trimmable resistive elements, $V_{os}$ of differential amplifier 10 can be trimmed to substantially zero volts and remains temperature independent.

Figure 2:
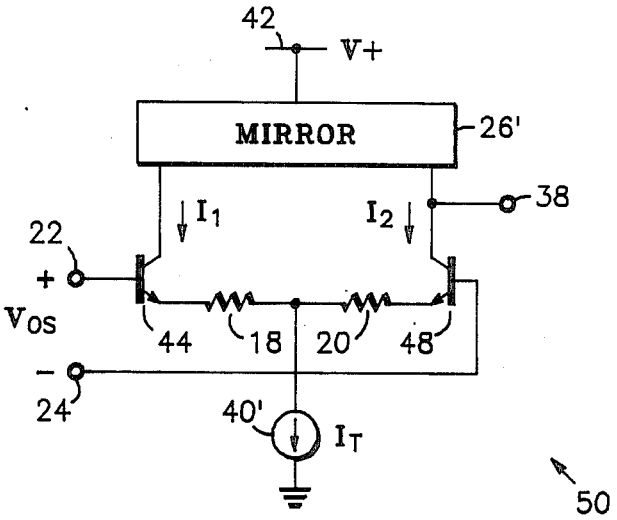
FIG. 2 is a schematic diagram of a differential amplifier of complementary conductivity type with respect to the differential amplifier of FIG. 1.

Turning to FIG. 2 there is illustrated differential amplifier 50 which is realized using complementary transistors with respect to differential amplifier 10. Components of differential amplifier 50 corresponding to like components of FIG. 1 are designated with the same reference numerals. Differential amplifier includes a pair of NPN transistors 44 and 48 differentially coupled together in the manner described above. The operation of differential amplifier 50 is substantially the same as described with regards to differential amplifier 10. It is understood that resistors 18 and 20 may or may not be included for differentially coupling the emitters of the transistors of differential amplifiers 10 and 50. Similarly, resistors 30 and 34 of the respective current mirrors may or may not be included. However, at least one set of trimmable resistors 18, 20 or 30, 34 must be utilized to provide the above described temperature independent offset voltage adjustment.

Thus, it has been shown that the voltage offset of a differential amplifier can be adjusted to zero volts by resistive trimming a current mirror or by resistive trimming differential emitter resistors 18 and 20 to provide a constant ratio of the currents I1 and I2 using a thermal tail current.

Figure 3:
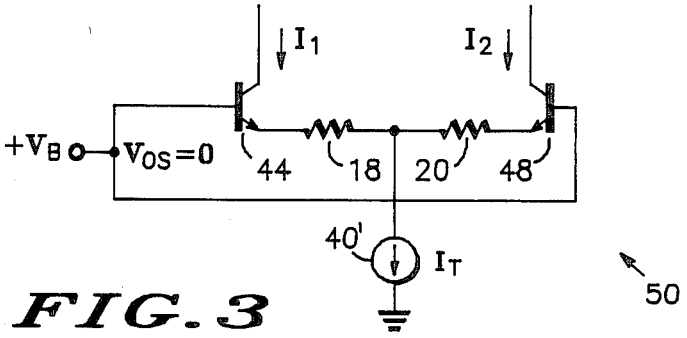
FIG. 3 is a schematic diagram of a current splitter of the present invention.
Figure 4:
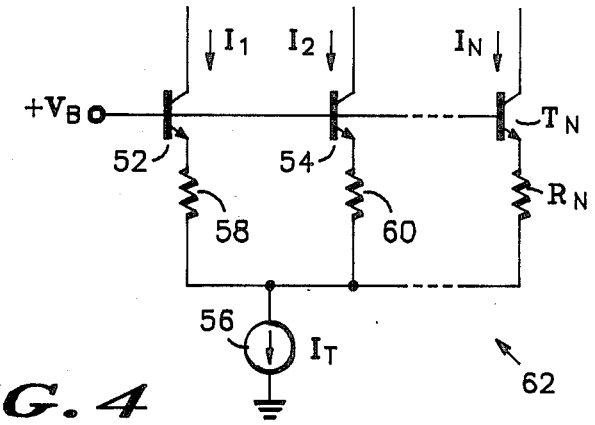
FIG. 4 is a schematic diagram of the current splitter of FIG. 3 as redrawn.

The present invention illustrated in FIGS. 3 and 4 is concerned with providing a current splitter circuit for producing multiple output currents having predetermined and precise constant ratios which remain independent of temperature. From equation (15) it can be shown, if $V_{os}$ is set to zero, that:

$$\ln MK_1 = [(R1/R)((R2/R1) - K_1)\ln K_0/(K_1+1)] \quad (17)$$

$V_{os}$ can be set to zero by shorting the bases of transistors 44 and 46 of differential amplifier 50, for instance, together. Hence, for a given value of M, R1, R2, R and $K_0$, there is one and only one value of $K_1$ (where $K_1$ is equal to I1/I2). Therefore, since $V_{os}$ is forced to zero, the temperature coefficient thereof is also forced to be zero and the ratio of I1 to I2 will remain constant over temperature. This is the significant feature of the present invention, i.e., any predetermined ratio of output currents can be derived by shorting the bases of transistors together and using resistive trimming in conjunction with a thermal current supply wherein the ratio remains temperature independent.

FIG. 4 more clearly shows the circuit of FIG. 3 to illustrate the current ratioing feature of the present invention. Current splitter 62 comprises at least transistors 52 and 54 having their bases shorted together and connected to a bias potential Vb. Thermal current supply 56 provides a thermal current for driving the emitters of the transistors via respective trimmable resistors 58 and 60. The ratio of the current I1 flowing through transistor 52 to the current I2 flowing through transistor 54 can be precisely adjusted to any predetermined value by trimming one or the other or both resistors 58 and 60. The adjusted ratio will remain constant and temperature independent. As illustrated multiple current ratios can be provided using additional transistors driven in parallel with transistors 52 and 54 from current supply 56. This is indicated by transistor $T_n$ which has its base connected to the bases of transistors 52 and 54 and its emitter coupled to current supply 56 via trimmable resistor $R_n$.

Thus, what has been described is a novel current splitter for providing current ratioing wherein the ratios of currents remain constant and temperature independent.

I claim:

1. Circuit for providing output currents the ratios of which are constant and temperature independent, comprising:

at least first and second transistors each having first and second electrodes and a control electrode with said control electrodes being connected together;

thermal current supply means for providing a reference thermal current, said reference thermal current having the form of (kT/qR) ln K, where k is Boltzmann's constant, q is the charge of an electron, R is a resistance of a given resistivity and temperature coefficient, T is absolute temperature and K is a constant; and trimmable resistive means having substantially the same temperature coefficient as said resistance R for coupling the respective first electrodes of said first and second transistors to said thermal current supply means such that proportional thermal currents flow through said transistors with the ratio of said proportional thermal currents being adjustable by trimming said trimmable resistive means whereby said adjusted ratio remains constant and temperature independent.

2. The circuit of claim 1 wherein said trimmable resistive means includes first and second trimmable resistors, said first resistor being coupled between said first electrode of said first transistor and said thermal current supply means and said second resistor being coupled between said first electrode of said second transistor and said thermal current supply means.

3. Monolithic integrated circuit for providing output currents the ratios of which are constant and temperature independent, comprising:

at least first and second transistors each having first and second electrodes and a control electrode with said control electrodes being connected together;

thermal current supply means for providing a thermal reference current, said thermal reference current having the form of (kT/qR) ln K, where k is Boltzmann's constant, q is the charge of an electron, R is a resistance of a given resistivity and temperature coefficient, T is absolute temperature and K is a constant; and trimmable resistive means having substantially the same temperature coefficient as said resistance R for coupling the respective first electrodes of said first and second transistors to said thermal current supply means such that proportional thermal currents flow through said transistors with the ratio of said proportional thermal currents being adjustable by trimming said trimmable resistive means whereby said adjusted ratio remains constant and temperature independent.

4. The circuit of claim 3 wherein said trimmable resistive means includes first and second trimmable resistors, said first resistor being coupled between said first electrode of said first transistor and said thermal current supply means and said second resistor being coupled between said first electrode of said second transistor and said thermal current supply means.

* * * * *